US012740630B1

(12) United States Patent
Lee et al.

(10) Patent No.: US 12,740,630 B1
(45) Date of Patent: Sep. 22, 2026

(54) COMPACT CONTAINER CAPABLE OF PREVENTING MESH CONTAMINATION

(71) Applicant: SAMHWA CO., LTD, Uiwang-si (KR)

(72) Inventors: Kyungchang Lee, Uiwang-si (KR); Dong Ju Kim, Suwon-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 0 days.

(21) Appl. No.: 19/185,479

(22) Filed: Apr. 22, 2025

(30) Foreign Application Priority Data

Mar. 18, 2025 (KR) ..... 10-2025-0034442

(51) Int. Cl.

| | |
|---|---|
| ***A45D 33/00*** | (2006.01) |
| ***A45D 33/02*** | (2006.01) |
| ***A45D 34/00*** | (2006.01) |
| ***A45D 40/22*** | (2006.01) |

(52) U.S. Cl.
CPC ..... *A45D 33/025* (2013.01); *A45D 34/00* (2013.01); *A45D 40/22* (2013.01)

(58) Field of Classification Search
CPC .. A45D 33/025; A45D 33/006; A45D 33/003; A45D 33/00; A45D 34/00; A45D 40/22; A45D 2200/051; A45D 2040/0006; A61K 2800/87; A61K 8/02; B65D 43/16
USPC ..... 206/37
See application file for complete search history.

(56) References Cited

U.S. PATENT DOCUMENTS

| | | | | | |
|---|---|---|---|---|---|
| 1,562,455 | A * | 11/1925 | Jones | A45D 33/006 | 222/205 |
| 2,143,058 | A * | 1/1939 | Decker | A45D 33/006 | 132/307 |
| 2,601,940 | A * | 7/1952 | Marcellus | A45D 33/02 | 222/405 |
| 2020/0054112 | A1* | 2/2020 | Lee | A45D 40/22 | |
| 2020/0305573 | A1* | 10/2020 | Lee | A45D 33/006 | |
| 2022/0031043 | A1* | 2/2022 | Kim | A45D 40/221 | |
| 2024/0315420 | A1* | 9/2024 | Yang | A45D 33/003 | |
| 2026/0054890 | A1* | 2/2026 | Jung | A45D 40/00 | |

FOREIGN PATENT DOCUMENTS

| | | | | |
|---|---|---|---|---|
| JP | H09140444 | A * | 6/1997 | |
| KR | 10-2016-0112353 | A | 9/2016 | |
| KR | 10-1803897 | B1 | 12/2017 | |
| KR | 102181366 | B1 * | 11/2020 | B65D 51/16 |

(Continued)

*Primary Examiner* — Gideon R Weinerth
(74) *Attorney, Agent, or Firm* — Bridgeway IP Law Group, PLLC; Jihun Kim

(57) ABSTRACT

A compact container that can protect the mesh from contamination by leakage during distribution is described. The compact container can include: a container body having a first and a second side wall; an auxiliary ring that includes a support flange and a coupling rim, where the support flange protrudes inward, and where the coupling rim extends downward from the support flange to tightly contact an outer surface of the first side wall; a mesh ring that is arranged over the auxiliary ring and includes a securing flange and an inner rim; and an application mesh that is made from a material having multiple pores and includes an edge part and a center part, where the edge part is secured between the support flange and the securing flange, and where the center part covers the holding space so as to be exposed to the outside through the exposure hole.

8 Claims, 5 Drawing Sheets

(56) References Cited

FOREIGN PATENT DOCUMENTS

| | | | | | |
|---|---|---|---|---|---|
| KR | 102222155 | B1 * | 3/2021 | ..... | B65D 83/771 |
| KR | 102631781 | B1 * | 1/2024 | ..... | A45D 33/008 |
| KR | 102916912 | B1 * | 1/2026 | ..... | B65D 83/771 |
| WO | WO-2021074518 | A1 * | 4/2021 | ..... | A45D 40/00 |

* cited by examiner

COMPACT CONTAINER CAPABLE OF PREVENTING MESH CONTAMINATION

CROSS-REFERENCE TO RELATED APPLICATIONS

This application claims the benefit of Korean Patent Application No. 10-2025-0034442, filed with the Korean Intellectual Property Office on Mar. 18, 2025, the disclosure of which is incorporated herein by reference in its entirety.

BACKGROUND

1. Technical Field

The present invention relates to a cosmetic container, more particularly to a compact container capable of effectively protecting the mesh from being contaminated by the leaking of a cosmetic held within the container in the form of a powder, cream, gel, liquid, etc., during distribution.

2. Description of the Related Art

A cosmetic such as a foundation, etc., is often provided in a compact container. The compact container, also known simply as a "compact", typically has a basic structure in which the content (cosmetic) is held within a lower case and an upper case is hinge-coupled to the lower case. A powder puff may be placed over the powder product, and a mirror may be mounted on the inner side of the upper case.

The content held in a compact container may be provided in the form of a powder, cream, gel, or the like, and since the holding space in which this content is held is exposed through a relatively large opening, it is important that the compact container prevent any leakage of the product during distribution and while being carried by the user. This issue is of even greater importance, considering the fact that the content of the compact container is generally a cosmetic, which can cause considerable contamination if inadvertently applied onto a surrounding object.

To minimize the occurrence of a content spilling out during the use of a compact container, a structure may be used in which a mesh is mounted in the compact container to cover the opening of the holding space in which the content is held. The mesh can be formed from a porous material, and the user may dab the mesh with a puff such that the content under the mesh is transferred onto the puff.

As another way to minimize the leakage of content during the distribution of the compact container, a plastic film may be placed or attached over the content within the compact container. After purchasing the compact container, the user may remove the plastic film to access the content in the compact container with a tool such as a puff, etc. A logo, etc., of the distributor may be printed on the plastic film.

However, even when the compact container includes a plastic film, the leakage of the content cannot be completely prevented, since the properties of the powder, cream, and gel held in the compact container allow the content to easily infiltrate the gaps between parts forming the compact container. Impact applied on the products during distribution can cause the content of the compact container to leak through gaps between parts for mounting the aforementioned mesh and the container body and/or gaps between parts for filling the content in the holding space, as a result of which the content may end up on the surface of the plastic film. Such a phenomenon has been observed in numerous compact containers. If there is content transferred onto the surface of the plastic film, the consumers' appraisal of the product would inevitably suffer, regardless of how high the quality of the product or how renowned the trademark of the product.

SUMMARY OF THE INVENTION

An aspect of the present invention, which was conceived to resolve the problem described above, is to provide a compact container that can prevent the leakage of the content and the resultant contamination of the mesh during use and during distribution without sacrificing user convenience.

Other objectives of the present invention will be more clearly understood from the embodiments set forth below.

One aspect of the invention provides a compact container that includes: a container body having a first side wall and a second side wall, where the first side wall may define a holding space for holding a content, and the second side wall may be formed on the outer side of the first side wall at a position separated from the first side wall such that a coupling space is formed between the second side wall and the first side wall; an auxiliary ring that is coupled to the container body and includes a support flange and a coupling rim, where the support flange may protrude inward from the upper end of the first side wall and may have a through hole formed on the inner side, and where the coupling rim may extend downward from the support flange and may be configured to tightly contact an outer surface of the first side wall; a mesh ring that is arranged over the auxiliary ring, is coupled to the container body, and includes a securing flange and an inner rim, where the securing flange may protrude inward above the support flange and may have an exposure hole formed on the inner side, with the inner rim extending downward from the securing flange and configured to be inserted between the coupling rim and the second side wall; and an application mesh that is made from a material having multiple pores and includes an edge part and a center part, where the edge part may be secured between the support flange and the securing flange, and where the center part may cover a top of the holding space so as to be exposed to the outside through the exposure hole.

A compact container according to an embodiment of the present invention can include one or more of the following features. For example, the auxiliary ring can be formed from an elastically deformable material.

The inner rim and the coupling rim can be forced into the coupling space such that an inner surface of the inner rim tightly contacts an outer surface of the coupling rim and an outer surface of the inner rim tightly contacts an inner surface of the second side wall.

A portion of the edge part of the application mesh can be secured between the inner rim and the coupling rim.

A coupling groove can be formed in either one of the inner surface of the inner rim and the outer surface of the coupling rim, a coupling protrusion configured to be inserted into the coupling groove can be formed in the other of the inner surface of the inner rim and the outer surface of the coupling rim, and a portion of the edge part of the application mesh can tightly contact the coupling protrusion within the coupling groove.

The mesh ring can further include an outer rim that extends downward from the securing flange on an outer side of the inner rim, and the second side wall can be inserted between the outer rim and the inner rim.

The mesh ring can further include a securing spike that protrudes downward from a bottom of the securing flange.

The through hole can be designed to be smaller in size than the exposure hole.

An embodiment of the present invention having the features above can provide various advantageous effects including the following. However, an embodiment of the present invention may not necessarily exhibit all of the effects below.

A compact container according to an embodiment of the invention includes an auxiliary ring together with a mesh ring so as to prevent the content from leaking through the contact portions between parts for securing the application mesh and the container body during distribution. The structure of such a compact container can effectively prevent the leaking of the content without sacrificing the convenience of use, so that the compact container may maintain a clean and elegant appearance.

DETAILED DESCRIPTION OF THE INVENTION

Figure 1:
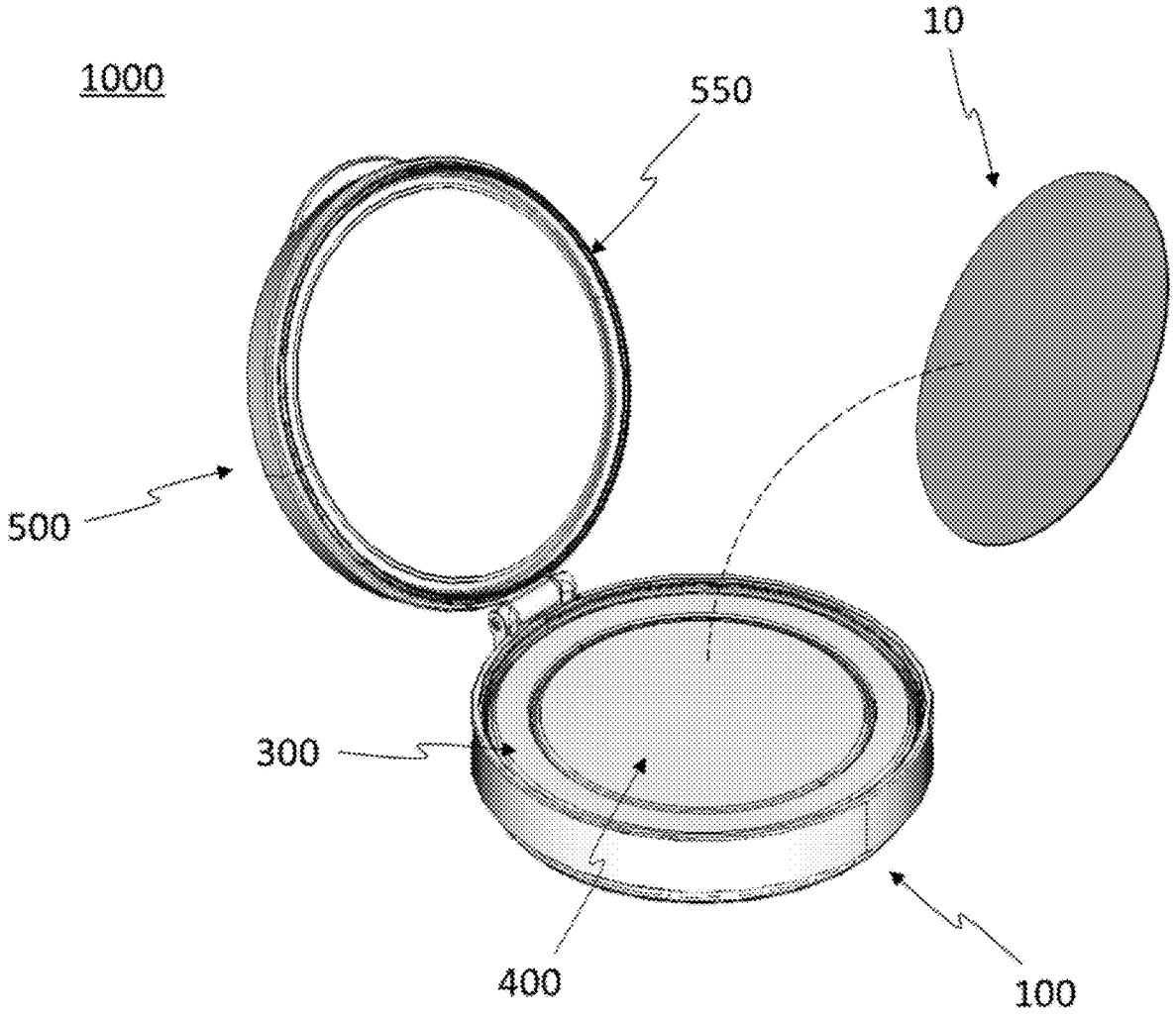
FIG. 1 is a perspective view of a compact container according to an embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

Certain embodiments of the present invention will be described below in more detail with reference to the accompanying drawings. Those components that are the same or are in correspondence are rendered the same reference numeral, and redundant descriptions are omitted.

For convenience, the specification uses terms such as "inner", "outer", "upper", and "lower". In the descriptions below, an "inner" side refers to a side closer to the interior of the compact container 1000, whereas an "outer" side refers to a side further away from the interior of the compact container 1000. An "upper" and a "lower" direction are used to describe the compact container 1000 when it is oriented as in FIG. 3. Of course, when a compact container 1000 according to an embodiment of the invention is actually in use, the directions mentioned in the specification may not coincide with the actual directions of the parts described.

FIG. 1 is a perspective view of a compact container 1000 according to an embodiment of the invention. When the user first uses the compact container 1000, the user may first open the lid 500 and remove the sealing tape 10, as illustrated in FIG. 1, and then dab the application mesh 400, which is exposed through the exposure hole 370 of the mesh ring 300, with a tool (not shown) such as a puff, etc., to transfer the content underneath onto the puff (not shown).

Figure 2:
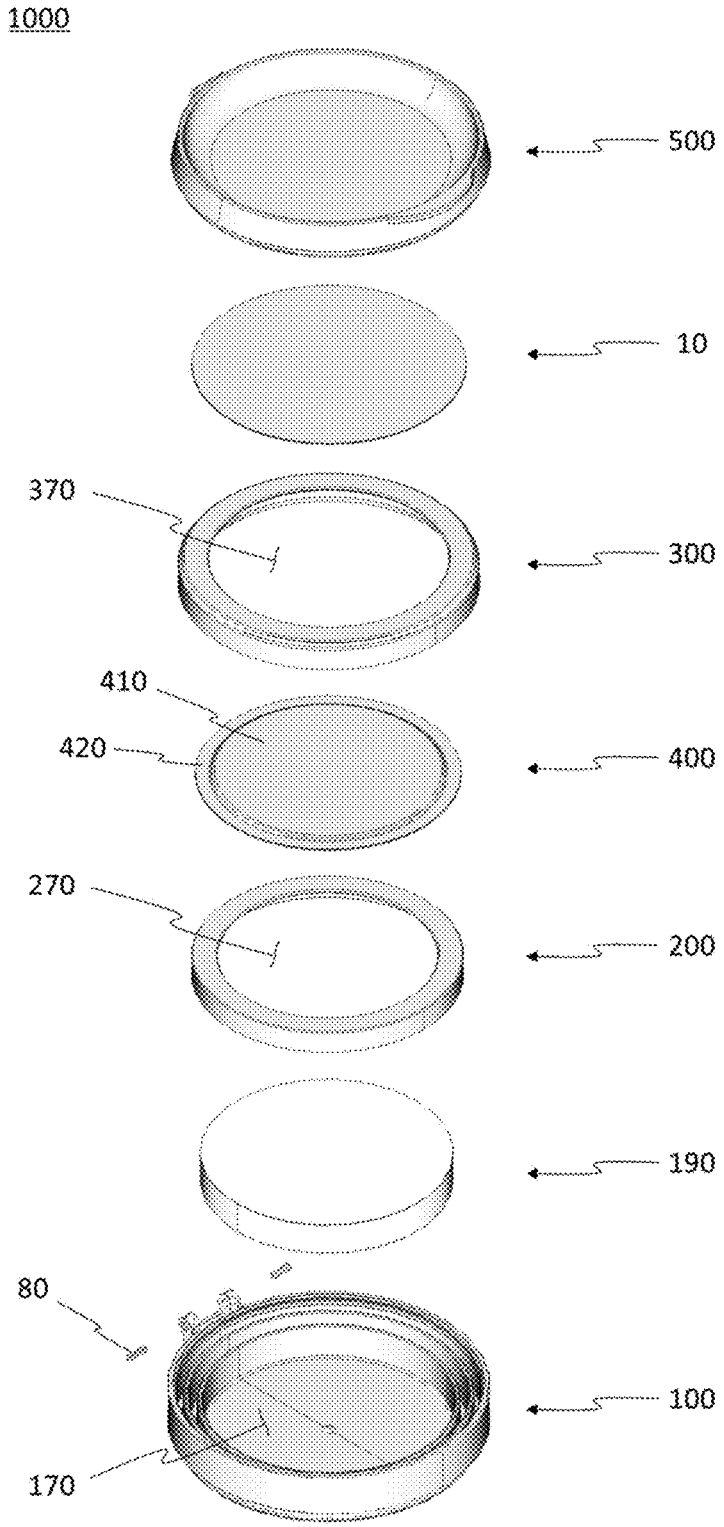
FIG. 2 is an exploded perspective view of a compact container according to an embodiment of the invention.
Figure 3:
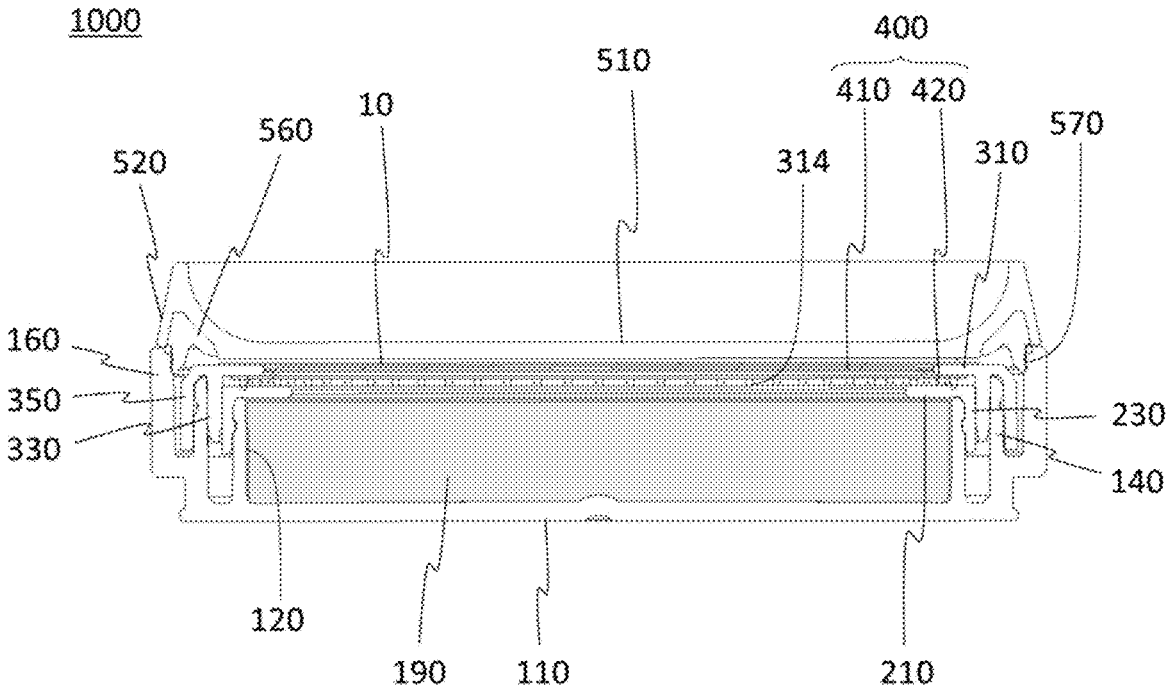
FIG. 3 is a cross-sectional view of a compact container according to an embodiment of the invention.

FIG. 2 and FIG. 3 are an exploded perspective view and a cross-sectional view, respectively, illustrating the composition of the compact container 1000 in more detail. FIGS. 4 to 7 illustrate certain components of the compact container 1000 in greater detail. Referring to FIGS. 1 to 7, a compact container 1000 according to an embodiment of the invention can mainly include a container body 100, an auxiliary ring 200, a mesh ring 300, an application mesh 400, and a lid 500. A compact container 1000 according to an embodiment of the invention can further include an upper case, a lower case, etc., in addition to the structure illustrated in FIGS. 1 to 3.

Figure 4:
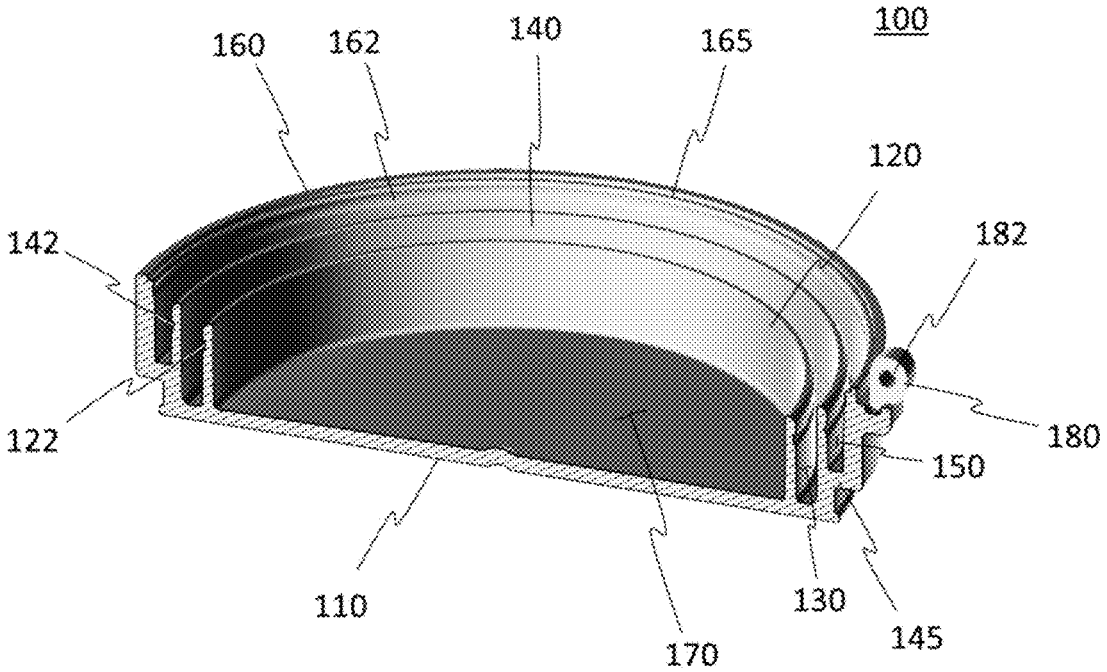
FIG. 4 is a cross-sectional perspective view of the container body in a compact container according to an embodiment of the invention.

The container body 100 can form a holding space 170 on its inner side and can serve as the main body onto which other components may be coupled. FIG. 4 is a cross-sectional perspective view of the container body 100 in a compact container 1000 according to an embodiment of the invention. As illustrated in FIGS. 1 to 4, the container body 100 can mainly include a base part 110, a first side wall 120, a second side wall 140, a third side wall 160, and a hinge part 180.

The base part 110 can form the bottom of the container body 100. Together with the first side wall 120, the base part 110 can define the holding space 170. That is, the holding space 170 can be formed above the base part 110 on the inner side of the first side wall 120.

The first side wall 120 can extend upward from the base part 110 and can form the holding space 170 for holding the content (not shown) on its inner side. The inner diameter and length of the first side wall 120 with respect to the longitudinal direction can be determined in consideration of the size of the holding space 170, the elasticity of the application mesh 400 and the auxiliary ring 200, etc. Although the drawings illustrate an example in which the first side wall 120 of the container body 100 is formed in a cylindrical shape and thus has an annular cross section, the first side wall 120 and the holding space 170 can be implemented in any of a variety of shapes.

A protrusion and/or indentation for coupling with the auxiliary ring 200 can be formed on the first side wall 120. For example, in the structure illustrated in FIG. 3 and FIG. 4, a coupling groove 122 is formed in the outer surface of the first side wall 120, and when the auxiliary ring 200 is coupled to the container body 100, a coupling protrusion 232 of the auxiliary ring 200 may be inserted into the coupling groove 122 of the first side wall 120.

The content held in the holding space 170 of the container body 100 can be provided in any of a variety of forms, such as a powder, cream, gel, liquid, etc. In cases where the content is a liquid having a relatively low viscosity, the content can be placed in holding space 170 while impregnated in an absorber unit 190. The absorber unit 190 can be made of a porous material such as a sponge and can hold the liquid content within its pores.

The second side wall 140 can be formed on the outer side of the first side wall 120 and can be separated by a particular gap from the first side wall 120, so that a first coupling space 130 may be formed between the first side wall 120 and the second side wall 140. Although the drawings illustrate an example in which the second side wall 140 extends upward from the base part 110, the second side wall 140 can be implemented in any of a variety of structures, as long as it is separated from the first side wall 120 to form a coupling space 130.

A protrusion and/or indentation for coupling with the mesh ring 300 can be formed on the second side wall 140. For example, in the structure illustrated in FIG. 3 and FIG. 4, a coupling groove 142 is formed in the outer surface of the second side wall 140, and when the mesh ring 300 is coupled to the container body 100, a coupling protrusion 352 of the mesh ring 300 may be inserted into the coupling groove 142 of the second side wall 140. Obviously, a protrusion and/or indentation can be formed in the inner surface of the second side wall 140 as well.

The third side wall 160 can be formed on the outer side of the second side wall 140 and can be separated by a particular gap from the second side wall 140, so that a second coupling space 150 may be formed between the second side wall 140 and the third side wall 160. The drawings illustrate an example in which the third side wall 160 extends upward from a bridge 145 that connects to the second side wall 140. Of course, the third side wall 160 can also be made to extend upward from the base part 110. However, as the bridge 145 that connects the third side wall 160 is formed at a higher position above the base part 110, a stepped portion may be formed under the bridge 145, and such a stepped portion can be useful for aligning and firmly coup-ling the container body 100 with respect to a lower case (not shown) in cases where the container body 100 is coupled to a separate lower case (not shown) as mentioned above.

A protrusion and/or indentation for coupling with the lid 500 can be formed on the third side wall 160. For example, in the structure illustrated in FIG. 3 and FIG. 4, a coupling groove 162 is formed in the inner surface of the third side wall 160, and when the lid 500 is closed over the container body 100, the sealing protrusion 570 of the sealing member 550 may be inserted into the coupling groove 162 of the third side wall 160.

A contact groove 165 can be formed in the upper end of the third side wall 160. When the lid 500 is closed over the container body 100, a portion of the sealing member 550 can experience elastic deformation and be forced into the contact groove 165, with the result that the sealing performance of the sealing member 550 can be improved.

The hinge part 180 can be formed on one side of the container body 100 to be used for rotatably coupling the lid 500. Rotation holes 182, 582 can be formed in the hinge parts 180, 580 of the container body 100 and lid 500, and when hinge pins 80 (see FIG. 2) are inserted into the rotation holes 182, 582 while the hinge part 180 of the container body 100 and the hinge part 580 of the lid 500 are aligned with each other, the lid 500 may be made rotatable about the hinge pin 80 with respect to the container body 100. When the user wishes to use the content within the holding space 170, the user can rotate and lift the lid 500.

Figure 5:
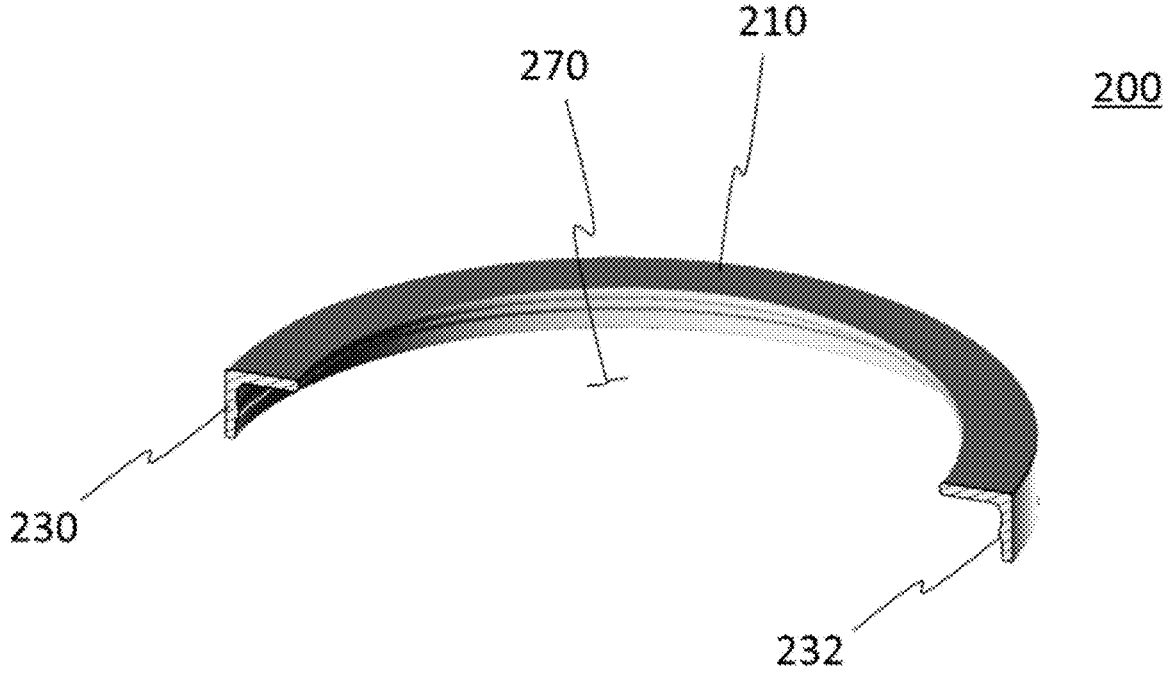
FIG. 5 is a cross-sectional perspective view of the auxiliary ring in a compact container according to an embodiment of the invention.

The auxiliary ring 200 can be arranged under the mesh ring 300 to suppress the leaking of the content from the holding space 170. FIG. 5 is a cross-sectional perspective view of the auxiliary ring 200 in a compact container 1000 according to an embodiment of the invention. As illustrated in FIG. 5, the auxiliary ring 200 can mainly include a support flange 210 and a coupling rim 230.

The support flange 210 may be a part that covers the upper end of the first side wall 120 of the container body 100. The support flange 210 can have a generally flat shape. The support flange 210 can protrude inward from the upper end of the coupling rim 230, and the coupling rim 230 can extend downward from the outer edge of the support flange 210. With the support flange 210 and the coupling rim 230 shaped thus, the auxiliary ring 200 can have a cross section shaped as an inverted "L", as illustrated in FIG. 5.

The support flange 210 can form a through hole 270 on its inner side. When the auxiliary ring 200 is coupled to the container body 100, the support flange 210 can protrude inward from the upper end of the first side wall 120, and the through hole 270 can be positioned over the holding space 170.

The coupling rim 230 can extend downward from the support flange 210, and when the auxiliary ring 200 is coupled to the container body 100, the coupling rim 230 can tightly contact the outer surface of the first side wall 120.

A protrusion and/or indentation for coupling with the auxiliary ring 200 can be formed on the coupling rim 230. For example, in the structure illustrated in FIGS. 3 to 5, a coupling protrusion 232 is formed on the inner surface of the coupling rim 230, and when the auxiliary ring 200 is coupled to the container body 100, the coupling protrusion 232 of the coupling rim 230 may be inserted into the coupling groove 122 of the first side wall 120.

Although it is not illustrated in the drawings, a protrusion and/or indentation for coupling with the auxiliary ring 200 can also be formed on the support flange 210. For example, a downwardly protruding coupling protrusion (not shown) can be formed on the lower surface of the support flange 210, and when the auxiliary ring 200 is coupled to the container body 100, the first side wall 120 can be inserted between the coupling rim 230 and the coupling protrusion (not shown) of the support flange 210.

In a preferred embodiment of the invention, whereas the container body 100 and the mesh ring 300 can be formed from a relatively hard material, the auxiliary ring 200 can be formed from a softer material, preferably a material that allows a slight degree of elastic deformation. The auxiliary ring 200 can also be fabricated from a material that cannot be penetrated by the content held in the holding space 170. A material such as TPE (thermoelastic elastomer), for example, can be used as the material for the auxiliary ring 200. As the auxiliary ring 200 is formed from an elastically deformable material such as TPE, etc., a slight degree of compression can occur when the auxiliary ring 200 is pressed against the container body 100, and this can increase the sealing performance of the auxiliary ring 200 with respect to the container body 100.

Figure 6:
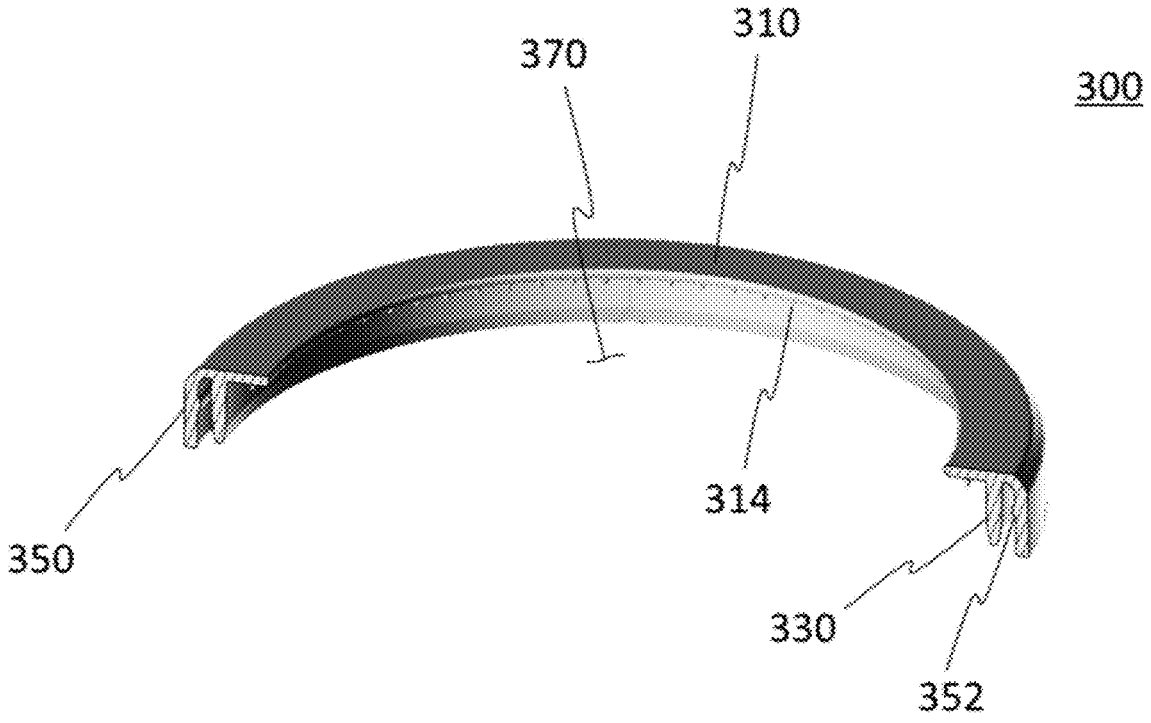
FIG. 6 is a cross-sectional perspective view of the mesh ring in a compact container according to an embodiment of the invention.

The mesh ring 300 can serve to couple the application mesh 400 onto the container body 100. FIG. 6 is a cross-sectional perspective view of the mesh ring 300 in a compact container 1000 according to an embodiment of the invention. As illustrated in FIG. 6, the mesh ring 300 can mainly include a securing flange 310, an inner rim 330, and an outer rim 350.

The securing flange 310 may be the part that covers the support flange 210 of the auxiliary ring 200. The securing flange 310 can have a generally flat shape and can be shaped to surround the center part 410 of the application mesh 400 that is exposed at the top of the container body 100 when the mesh ring 300 and the application mesh 400 are coupled together to the container body 100.

The securing flange 310 can form an exposure hole 370 on the inner side. The mesh ring 300 can be coupled, together with the application mesh 400 and the auxiliary ring 200, to the container body 100, where the securing flange 310 and the support flange 210 can secure the application mesh 400, and the center part 410 of the application mesh 400 can be exposed to the outside at the top of the container body 100 through the exposure hole 370 of the mesh ring 300.

As illustrated in FIG. 2 and FIG. 3, a sealing tape 10 can be provided between the lid 500 and the container body 100. In an embodiment of the invention, the sealing tape 10 can be formed in a size that can cover at least a portion of the securing flange 310 of the mesh ring 300 and the application mesh 400 on its inner side. The sealing tape 10 can be attached to the securing flange 310 of the mesh ring 300. The sealing tape 10 can be adhered to the securing flange 310 to completely block the exposure hole 370. The sealing tape 10 can be made from a transparent material or can be made from an opaque material to have a logo, etc., printed thereon. The flat lower surface formed by the cover part 510 of the lid 500 and the flat upper surface formed by the securing flange 310 can aid in securing the sealing tape 10 in its designated position.

Securing spikes 314 can be formed on the bottom surface of the securing flange 310. The securing spikes 314 can be shaped to become narrower towards the bottom so as to be pointy at the lower end and can be formed in a particular interval along the entire securing flange 310. The securing spikes 314 can aid in securing the application mesh 400.

The inner rim 330 can extend downward from the securing flange 310. When the mesh ring 300, together with the auxiliary ring 200 and the application mesh 400, are coupled to the container body 100, the inner rim 330 and the coupling rim 230 can be inserted into the coupling space 130 formed between the first side wall 120 and second side wall 140 of the container body 100.

Although it is not illustrated in the drawings, a protrusion and/or indentation for coupling with the container body 100 and/or auxiliary ring 200 can be formed on the inner rim 330. For example, a coupling groove can be formed in either one of the inner surface of the inner rim 330 and the outer surface of the coupling rim 230, while a coupling protrusion configured to be inserted into the coupling groove can be formed in the other.

The outer rim 350 can extend downward from the securing flange 310 at an outer side of the inner rim 330. The outer rim 350 can be formed with a particular gap from the inner rim 330. When the mesh ring 300 is coupled to the container body 100, the outer rim 350 can be inserted into the second coupling space 150 formed between the second side wall 140 and the third side wall 160, and the second side wall 140 can be inserted between the inner rim 330 and the outer rim 350.

The outer rim 350 can be used to secure the mesh ring 300 to the container body 100, and for this purpose, protrusions and/or indentations for coupling can be formed in the inner perimeter and/or outer perimeter of the outer rim 350. In the example illustrated in FIG. 3 and FIG. 6, a coupling protrusion 352 is formed in the inner perimeter of the outer rim 350, and the mesh ring 300 can be coupled to the container body 100 as the coupling protrusion 352 of the outer rim 350 is inserted into the coupling groove 142 of the second side wall 140.

The application mesh 400 may correspond to a part that covers the holding space 170 at a position below the exposure hole 370 of the mesh ring 300. The application mesh 400 can be made from a material having multiple pores. When using the content of the compact container 1000, the user can dab the application mesh 400 with a tool such as a puff, etc., at which the content within the holding space 170 may be transferred onto the puff through the pores of the application mesh 400.

The application mesh 400 can include a center part 410 and an edge part 420. The center part 410 corresponds to a portion of the application mesh 400 that is exposed through the exposure hole 370 of the mesh ring 300, while the edge part 420 corresponds to a portion that surrounds the center part 410 and is hidden by the mesh ring 300. In FIG. 2, the application mesh 400 is depicted as having a 3-dimensional shape. Although it is possible to fabricate the application mesh 400 to have a certain degree of structural strength, for example by forming the application mesh 400 as a metal mesh having pores, an application mesh 400 according to an embodiment of the invention can be fabricated from a fiber material having a level of elasticity and negligible structural strength. In such cases, the application mesh 400 can be fabricated in a simple planar shape. The application mesh 400 can be secured in its designated position, as the edge part 420 is arranged between the mesh ring 300 and the auxiliary ring 200.

In cases where the application mesh 400 is fabricated in a planar shape, the application mesh 400 can be formed in a size larger than that of the exposure hole 370 so as to completely cover the exposure hole 370 of the mesh ring 300. In a preferred embodiment of the invention, the application mesh 400 can be formed with a diameter smaller than or equal to the inner diameter of the inner rim 330 of the mesh ring 300. In another preferred embodiment of the invention, the application mesh 400 can be formed with a diameter greater than the inner diameter of inner rim 330.

Figure 7:
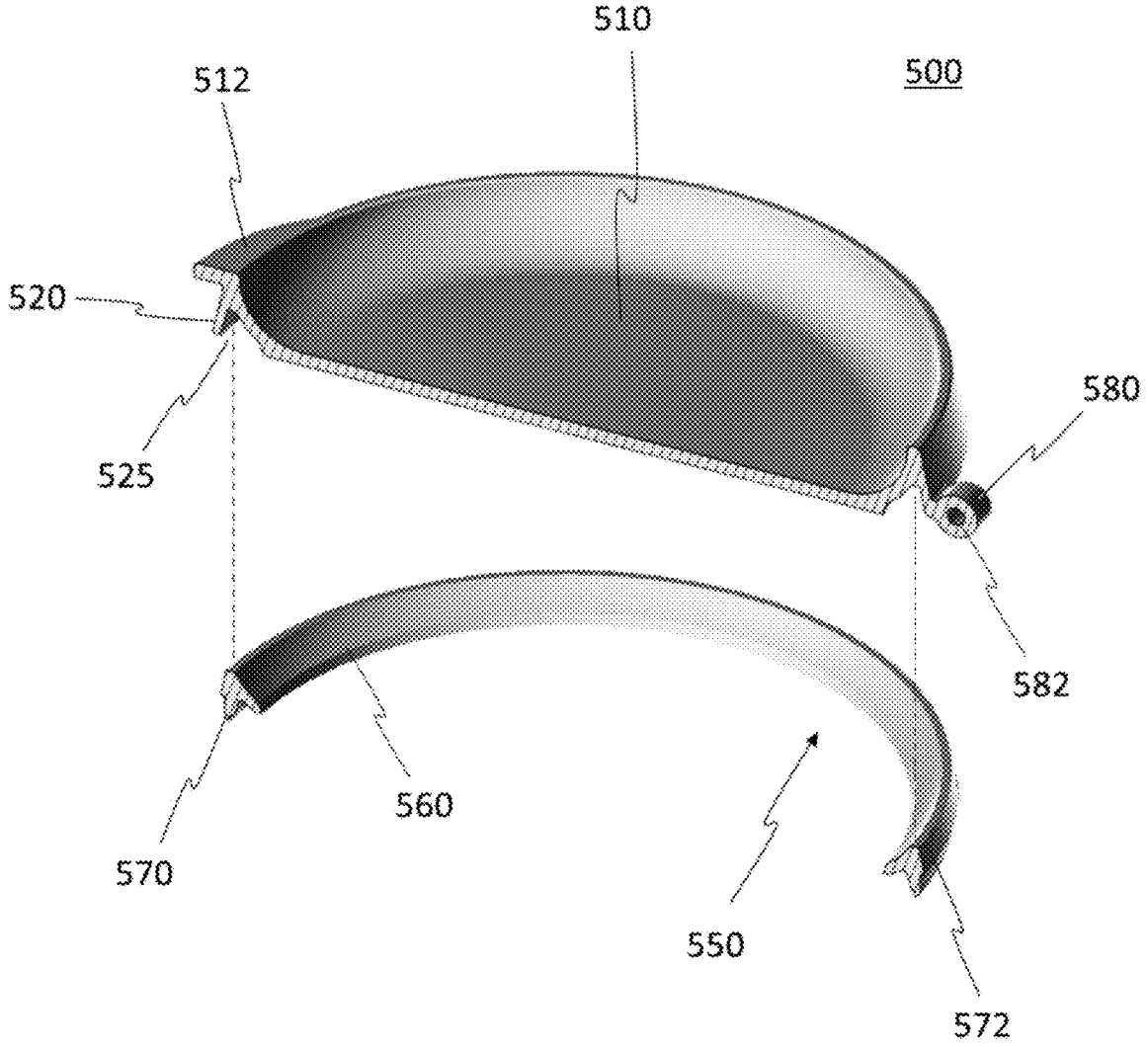
FIG. 7 is a cross-sectional perspective view of the lid in a compact container according to an embodiment of the invention.

The lid 500 may be the part that is hinge-coupled to the container body 100 to cover the application mesh 400 arranged over the holding space 170. FIG. 7 is a cross-sectional perspective view of the lid 500 in a compact container 1000 according to an embodiment of the invention. As illustrated in FIG. 7, the lid 500 can mainly include a cover part 510, an edge part 520, a sealing ring 550, and a hinge part 580.

The cover part 510 may the main part of the lid 500 and may correspond to a part that is covered over the container body 100. The cover part 510 can have a flat lower surface, and in a preferred embodiment of the invention, this flat lower surface can be configured to completely cover the exposure hole 370 of the mesh ring 300. When the lid 500 is closed, the flat lower surface of the cover part 510 can rest on the flat upper surface of the securing flange 310 of the mesh ring 300.

As in the example illustrated in FIG. 3 and FIG. 7, the edge of the cover part 510 can be curved upward. This can form a space in which to place a tool such as a puff, etc., in the middle in an upper portion of the cover part 510 while also forming a mounting groove 525 for inserting the sealing ring 550 on the edge in a lower portion of the cover part 510.

The edge part 520 can extend downward from the edge of the cover part 510. As the edge part 520 extends downward in a sloped manner from the upwardly curved portion of the cover part 510, a mounting groove 525 can be formed on the inner side of the edge part 520.

A protruding tab 512 can be formed on the opposite side of the lid 500 from where the hinge part 580 is formed. The protruding tab 512 may serve as a handle by which the user may easily open the lid 500. The protruding tab 512 can be formed on the cover part 510 and/or the edge part 520.

The sealing ring 550 can be inserted in the mounting groove 525 formed in the cover part 510 and edge part 520 to increase the sealing performance with respect to the container body 100 when the lid 500 is closed. The sealing ring 550 can include a mount part 560, which may have a shape corresponding to that of the mounting groove 525, and a sealing protrusion 570, which may extend downward from the mount part 560. When the lid 500 is closed to cover the application mesh 400, the sealing protrusion 570 can be tightly coupled to the third side wall 160 of the container body 100, as illustrated in FIG. 3, and can be partially inserted into the coupling groove 162 formed in the third side wall 160. The mount part 560 of the sealing ring 550 can also partially be in tight contact with the third side wall 160. The mount part 560 can, for example, be pressed and forced into the contact groove 165 of the third side wall 160.

A hinge part 580 can be formed on the lid 500, and a rotation hole 582 can be formed in the hinge part 580 through which the hinge pin 80 may pass. The lid 500 can be arranged such that the rotation hole 582 is aligned with the rotation holes 182 of the hinge part 180 on the container body 100, and when hinge pins 80 are inserted through the rotation holes 182, 582, the lid 500 can be coupled so as to be rotatable about the hinge pins 80.

The following provides a more detailed description on the assembly and functioning of a compact container 1000 according to an embodiment of the invention. The process of assembling the compact container 1000 can be performed manually by a person or can be performed automatically by an assembly apparatus. In the descriptions below, the entity performing the assembly is referred to as an "operator".

After the container body 100, auxiliary ring 200, mesh ring 300, application mesh 400, and lid 500 described above are fabricated, the operator can fill the holding space 170 of the container body 100 with a content. The content can be held directly in the holding space 170 or can be held while impregnated in an absorber unit 190.

The operator can place the application mesh 400 under the securing flange 310 of the mesh ring 300 and place the auxiliary ring 200 under the mesh ring 300 such that the edge part 420 of the application mesh 400 is secured between the securing flange 310 and the support flange 210. The coupling rim 230 can be formed to have an outer diameter corresponding to the inner diameter of the inner rim 330, and therefore the auxiliary ring 200 can be forced into the inner side of the inner rim 330 such that the outer surface of the coupling rim 230 is in tight contact with the inner surface of the inner rim 330.

As described above, the mesh ring 300 can include securing spikes 314 that protrude downward from the bottom surface of the securing flange 310, where the securing spikes 314 can be formed to be pointy at the lower ends so as to effectively secure the application mesh 400, which is formed with tiny pores. It is possible to have securing holes (not shown) formed in the auxiliary ring 200 into which the securing spikes 314 may be inserted, and it is also possible to have the application mesh 400 secured by the pointy ends of the securing spikes 314 without having securing holes formed.

In the example illustrated in FIG. 3, the application mesh 400 is formed with a diameter that is smaller than or equal to the inner diameter of the inner rim 330, so that the edge part 420 of the application mesh 400 is positioned only between the securing flange 310 and the support flange 210. In another embodiment of the invention, the diameter of the application mesh 400 can be formed greater than the inner diameter of the inner rim 330, in which case a portion of the edge part 420 of the application mesh 400 can be positioned between the coupling rim 230 and the inner rim 330. In cases where a coupling groove is formed in either one of the inner surface of the inner rim 330 and the outer surface of the coupling rim 230 and a coupling protrusion is formed in the other, as described above, a portion of the edge part 420 can be placed in tight contact with the coupling protrusion while within the coupling groove. This structure can aid in more firmly securing the application mesh 400. In cases where the diameter of the application mesh 400 is formed greater than the inner diameter of the inner rim 330, having the auxiliary ring 200 inserted into the inner side of the inner rim 330 with the application mesh 400 positioned in-between can also provide the effect of the application mesh 400 being smoothly stretched out in the vicinity off the exposure hole 370.

The operator can force the coupling rim 230 and the inner rim 330, which have been arranged to be superimposed one over the other, into the coupling space 130 formed between the first side wall 120 and second side wall 140 of the container body 100. In cases where the auxiliary ring 200 is formed from an elastically deformable material, a slight amount of compression can occur at the coupling rim 230. For the forced insertion of the inner rim 330, the inner rim 330 can be shaped such that its lower end becomes narrower towards the bottom.

At the same time that the operator inserts the coupling rim 230 and the inner rim 330 into the first coupling space 130, the outer rim 350 may be inserted into the second coupling space 150 between the second side wall 140 and third side wall 160, while the second side wall 140 of the container body 100 may be inserted into the space between the inner rim 330 and outer rim 350. When the auxiliary ring 200 and the mesh ring 300 are moved down to their designated positions, the coupling protrusion 232 of the auxiliary ring 200 can be inserted into the coupling groove 122 formed in the corresponding position, and the coupling protrusion 352 of the mesh ring 300 can be inserted into the coupling groove 142 formed in the corresponding position of the container body 100, with the result that the auxiliary ring 200, mesh ring 300, and application mesh 400 can all be firmly secured to the container body 100. In cases where an absorber unit 190 is held in the holding space 170, the support flange 210 of the auxiliary ring 200 can secure the edge of the top of the absorber unit 190.

The operator can also rotatably couple the lid 500 to the container body 100 by using hinge pins 80 or some other hinge-related member. The operator can also attach a sealing tape 10 onto the mesh ring 300 as necessary.

While the foregoing refers to the auxiliary ring 200 and the mesh ring 300 being coupled together to the container body 100, it is possible for the operator to first couple the auxiliary ring 200 to the container body 100 and then couple the application mesh 400 and the mesh ring 300 to the container body 100 and auxiliary ring 200. Also, it is possible to have the lid 500 coupled to the container body 100 first, before the mesh ring 300 is coupled to the container body 100.

If even a small amount of content leaves the holding space 170 to end up on the mesh ring 300, application mesh 400, or the sealing tape 10, this would cause the consumer to have a low opinion of the corresponding product. This can be especially detrimental when the product relates to a cosmetic, as in the case of a compact container.

In a compact container 1000 according to an embodiment of the invention, the inner rim 330 of the mesh ring 300 and the coupling rim 230 of the auxiliary ring 200 can be inserted together into a coupling space 130 formed between the first side wall 120 and second side wall 140 of the container body 100, and the securing flange 310 of the mesh ring 300 can press down on the support flange 210 of the auxiliary ring 200. As described above, the auxiliary ring 200 can be formed from a material, such as a TPE material, that is softer than that of the container body 100 and mesh ring 300, with the result that the above coupling structure can cause the auxiliary ring 200 to very tightly contact the first side wall 120 at the upper end and outer surface of the first side wall 120.

Even if the content of the holding space 170 passes through a gap between the first side wall 120 and the auxiliary ring 200, the inner rim 330 and the coupling rim 230 that press against each other and are in tight contact with each other within the coupling space 130 can form another seal so as to suppress the leaking of the content to the exterior.

Thus, the structure of a compact container 1000 according to an embodiment of the invention can not only firmly secure and couple the container body 100, auxiliary ring 200, mesh ring 300, and application mesh 400 to one another but can also very effectively prevent the content from leaving the holding space 170 and leaking to the outside. During the distribution and sale of the product, not even a small amount of the content of the holding space 170 can be transferred onto the mesh ring 300, application mesh 400, or sealing tape 10, so that the compact container 1000 can maintain an elegant appearance.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A compact container comprising:

a container body having a first side wall and a second side wall, the first side wall defining a holding space for holding a content, the second side wall formed on an outer side of the first side wall at a position separated from the first side wall such that a coupling space is formed between the second side wall and the first side wall;

an auxiliary ring coupled to the container body and having a support flange and a coupling rim, the support flange protruding inward from an upper end of the first side wall and having a through hole formed on an inner side thereof, the coupling rim extending downward from the support flange and configured to contact an outer surface of the first side wall;

a mesh ring arranged over the auxiliary ring and coupled to the container body, the mesh ring having a securing flange and an inner rim, the securing flange protruding inward above the support flange and having an exposure hole formed on an inner side thereof, the inner rim extending downward from the securing flange and configured to be inserted between the coupling rim and the second side wall; and an application mesh made from a material having a plurality of pores, the application mesh having an edge part and a center part, the edge part being secured between the support flange and the securing flange, the center part covering a top of the holding space so as to be exposed to an outside through the exposure hole.

2. The compact container of claim 1, wherein the auxiliary ring is formed from an elastically deformable material.

3. The compact container of claim 2, wherein the inner rim and the coupling rim are forced into the coupling space such that an inner surface of the inner rim contacts an outer surface of the coupling rim and an outer surface of the inner rim contacts an inner surface of the second side wall.

4. The compact container of claim 3, wherein a portion of the edge part of the application mesh is secured between the inner rim and the coupling rim.

5. The compact container of claim 4, wherein a coupling groove is formed in either one of the inner surface of the inner rim and the outer surface of the coupling rim, a coupling protrusion configured to be inserted into the coupling groove is formed in an other of the inner surface of the inner rim and the outer surface of the coupling rim, and a portion of the edge part of the application mesh contacts the coupling protrusion within the coupling groove.

6. The compact container of claim 1, wherein the mesh ring further comprises an outer rim extending downward from the securing flange on an outer side of the inner rim, and the second side wall is inserted between the outer rim and the inner rim.

7. The compact container of claim 1, wherein the mesh ring further comprises a securing spike protruding downward from a bottom of the securing flange.

8. The compact container of claim 1, wherein the through hole is smaller in size than the exposure hole.

* * * * *